US006866532B1

(12) United States Patent
Huang

(10) Patent No.: US 6,866,532 B1
(45) Date of Patent: Mar. 15, 2005

(54) STRUCTURE OF A COMMUNICATION INTERNET CONNECTOR

(76) Inventor: Kui-Hsien Huang, PO Box 82-144, Taipei (TW)

( * ) Notice: Subject to any disclaimer, the term of this patent is extended or adjusted under 35 U.S.C. 154(b) by 0 days.

(21) Appl. No.: 10/658,293

(22) Filed: Sep. 10, 2003

(51) Int. Cl.[7] ..... H01R 4/50
(52) U.S. Cl. ..... 439/344; 439/676
(58) Field of Search ..... 439/344, 345, 439/354, 357, 358, 676, 372

(56) References Cited

U.S. PATENT DOCUMENTS 5,579,425 A * 11/1996 Lampert et al. ..... 385/59
6,238,251 B1 * 5/2001 Curtis et al. ..... 439/680
6,250,949 B1 * 6/2001 Lin ..... 439/418
6,532,653 B1 * 3/2003 Alpert ..... 29/881
6,595,798 B1 * 7/2003 Pook ..... 439/540.1

* cited by examiner

*Primary Examiner*—Hien Vu
(74) *Attorney, Agent, or Firm*—Leong C. Lei

(57) ABSTRACT

An improved structure of a communication Internet connector is disclosed. The corrector comprises a connector body, a press plate, engaging plate and a series conductive port. A pair of pivotal lugs are provided correspondingly on the surface of the connector body and at an appropriate distance from the position of the engaging plate mounted at one end at the front edge of the connector, the press plate is provided with a protruded shaft each at the bottom surface such that a pivotal moment is obtained when the pivotal shaft is pivotally mounted to the pivotal lugs. When the press plate is slightly depressed, the connector is disconnected from the connected PC or similar devices.

1 Claim, 4 Drawing Sheets

STRUCTURE OF A COMMUNICATION INTERNET CONNECTOR

BACKGROUND OF THE INVENTION (a) Technical Field of the Invention

The present invention relates to an Internet connector, and in particular, an improved structure of a connector having a press plate to provide a protection to the connector and to facilitate releasing the connector from a connected PC or the like.

(b) Description of the Prior Art

FIG. 1 is a communication Internet connector having an insertion engaging plate A1, a serial port A2 and cable A3. The engaging plate A1 is employed to engage with the interface connector of a PC or any digital product and the engaging plate can be elastically extended or can be rapidly compressed, allowing the Internet connector to be connected to the slot of the connector seat. The currently available Internet connector A10 has a structure that cannot be changed and there are drawbacks as shown below:

(a) The current connector A10 is installed from the production line and if the connector A10 accidentally falls the entire structure of the engaging plate A1 will either be damaged or deformed such that the entire structure cannot be used further, and it is common that the connector is connected to a cable, and thus, the cable and the connector will have to be discarded, and the cost of production is increased.

(b) It is possible that the elastic angle of the engaging plate A1 can be either too wide or too small which may cause it to dislocate with the PC if an appropriate force is applied. Therefore, the only method to protect this is to limit the change of the entire angle.

(c) The engaging plate A10 has to be depressed in order to disengage the connector from the connector PC, however, the engaging plate A10 is normally too deep inside the slot of the interface connector and it is common that the finger nail of the user will be accidentally damaged.

Accordingly, in view of the above drawbacks, it is an imperative that an improved Internet connector is designed so as to solve the drawbacks as shown above.

SUMMARY OF THE INVENTION

Accordingly, it is an object of the present invention to provide an improved structure of a communication Internet connector having a connector body, a press plate, engaging plate and serial conductive ports characterized in that a pair of pivotal lugs are provided correspondingly on the surface of the connector body and at an appropriate distance from the position of the engaging plate mounted at one end at the front edge of the connector, the press plate is provided with a protruded shaft each at the bottom surface such that a pivotal moment is obtained when the pivotal shaft is pivotally mounted to the pivotal lugs.

Yet another object of the present invention is to provide an improved structure of a communication Internet connector, wherein the front side of one pivotal lug is provided with a notch having a size slightly smaller than the diameter of the protruded shaft of the press plate.

Still another object of the present invention is to provide an improved structure of a communication Internet connector, wherein the engaging plate is restricted to certain angle of opening and is protected from deformation or damage.

The foregoing object and summary provide only a brief introduction to the present invention. To filly appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
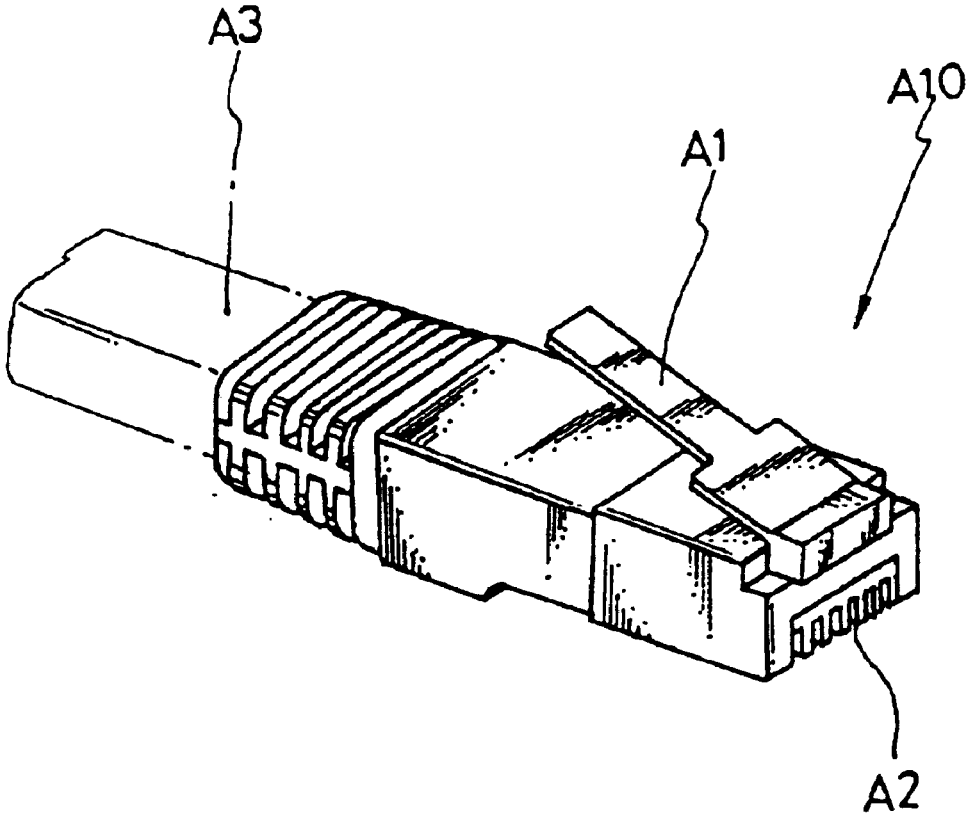
PRIOR ART FIG. 1
FIG. 1 is a perspective view of a conventional Internet connector.
Figure 2:
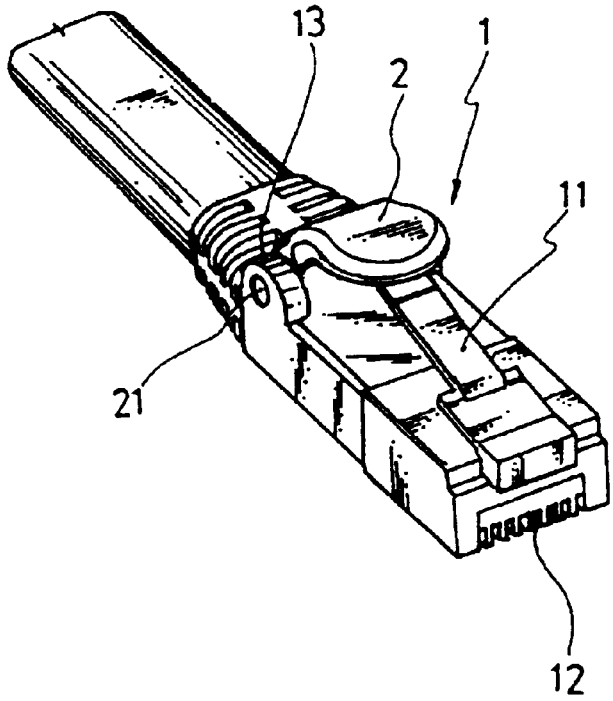
FIG. 2 is a perspective view of an Internet connector in accordance with the present invention.
Figure 3:
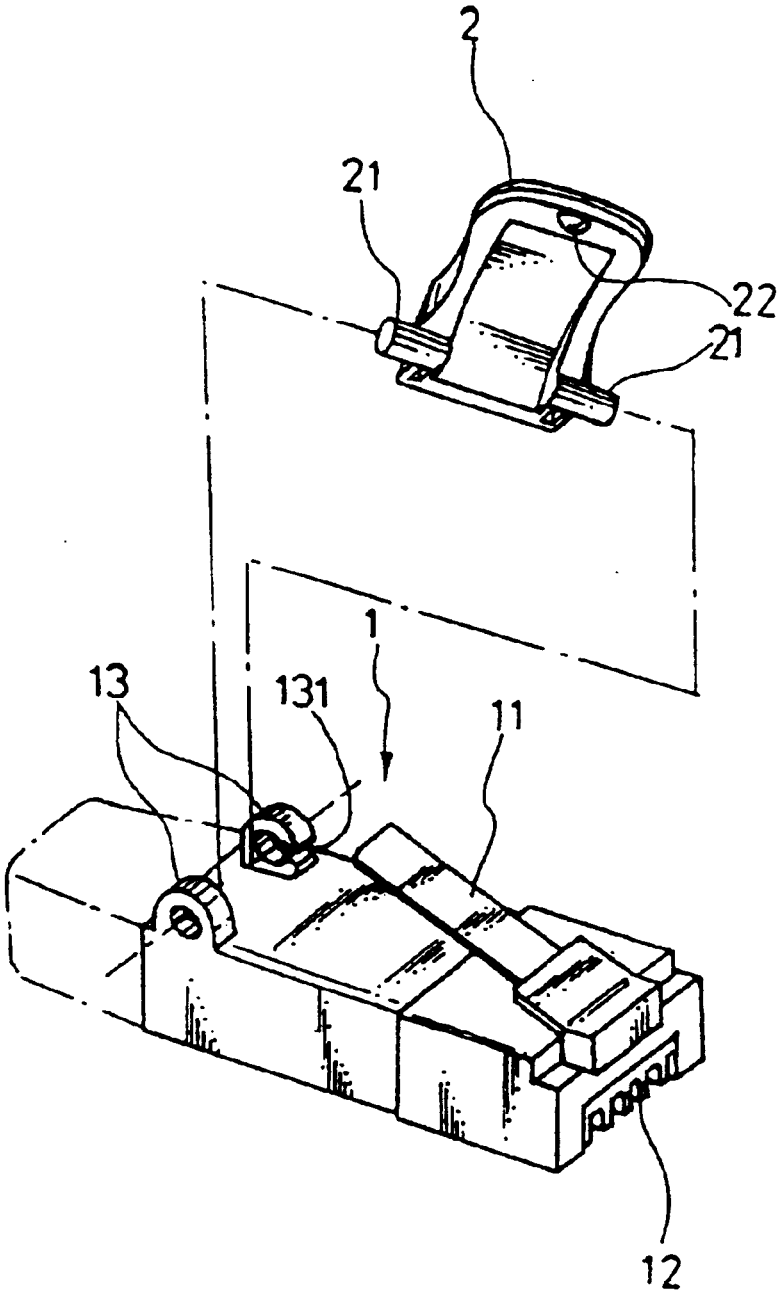
FIG. 3 is a perspective exploded view of the Internet connector in accordance with the present invention.

Referring to FIGS. 2 and 3, there is shown an improved structure of a communication Internet connector having a connector body, a press plate 2 and the configuration of the connector of the present invention is more or less alike the conventional connector. In accordance with the present invention, the connector 1 further includes an engaging plate 11 and a serial port 12. A pair of pivotal lugs 13 are mounted correspondingly on the surface of the connector body and on the same surface where the engaging plate 11 is mounted at one end thereof. The press plate 2 is pivotally mounted to the pivotal lugs 13 such that the press plate 11 is rotatable about the pivotal lugs 13.

Referring to FIG. 3, the front side of the pivotal lugs 13 has a notch 131 which allows the protruded shaft 21 which is provided below the bottom surface of the press plate 2 to be inserted therein. The size of the notch 131 is slightly smaller than the diameter of the protruded shaft 21. To install the press plate 2 into the pivotal lug 13, one of the protruded shafts 21 on the press plate 2 is inserted into the pivotal lug 13 and the other protruded shaft 21 of the press plate 2 is inserted first through the notch 131 to the other pivotal lug 13. Thus the press plate 2 can be balanced and pivotally mounted at the two pivotal lugs 13.

Figure 4:
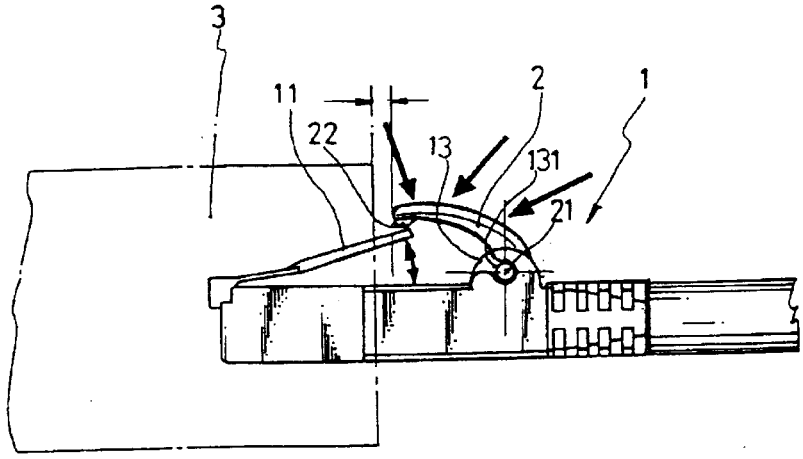
FIG. 4 is a sectional view showing the depression operation of the press plate of the Internet connector in accordance with the present invention.

As shown in FIG. 4, the press plate 2 is arch-shaped and at the rear side close to the two lateral side of the inner edge, the pair of protruded shaft 21 are mounted. As mentioned above, the protruded shafts 21 are pivotally inserted into the pivotal lug 13 so that the press plate 2 is rotatable about the pivotal lugs 13.

After the press plate 2 is pivotally mounted, the contact point 22 of the front end bottom edge will touch the top edge face of the engaging plate ll. The tension property of the engaging plate 11 will force to lift up the press plate 2. Due to the fact that the position of the protruded shaft 21 is closer to the front side of the press plate 2, the press plate 2 is restricted to open at an angle. This angle of this opening is slightly larger than the angle opening of engaging plate 11. Thus, the press plate 2 will not be flipped over, but the press plate 2 and the engaging plate 11 are in contact.

As shown in FIG. 4, when the connector 1 is connected to the interface connector 3, the function of engaging plate 11 is normal and the press plate 2 will not be activated or triggered. When the connector is plugged into the PC, there is a distance between the press plate 2 and the connector 3 and the press plate 2 will not touch the interface connector 3. At this, time the press plate 2 touches the top edge of the engaging plate 11. Thus, when the connector 1 is unplugged, and any point on the press plate 2 is touched, the depression will directly press the engaging plate 11 and the angle of opening of the engaging plate becomes smaller, thus, the connector 1 is rapidly disconnected from the connector 3.

In another preferred embodiment of the present invention, the pivotal lug 13 on the connector body can be replaced by the protruded shaft 21, and the protruded shaft 21 on the press plate 2 can be replaced with the pivotal lugs 13. In other words, the press plate 2 can provide a pivotal moment about a pivotal point so that the depressing of the press plate will touch the engaging plate and in turn, the connector 1 is disconnected from the interface connector.

It will be understood that each of the elements described above, or two or more together may also find a useful application in other types of methods differing from the described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a communication Internet connector comprising a connector body, a press plate, an engaging plate and a serial conductive port, wherein a pair of pivotal lugs are provided on one side of said connector body, said engaging plate is mounted at one and of said connector body, said press plate has two protruded shafts which are pivotally connected to said pivotal lugs so that said press plate is rotatable about said pivotal lugs, said pivotal lugs are formed with two notches for receiving said protruded shafts, said press plate is an arch-shaped member having a bottom provided with a contact point to touch a top of said engaging plate, said notches have a size slightly smaller than a diameter of said protruded shaft, and said serial conductive port is mounted at said one end of said connector body.

* * * * *